United States Patent [19]

Krieg

[11] Patent Number: 4,842,139

[45] Date of Patent: Jun. 27, 1989

[54] CYLINDER CONTAINMENT VESSEL

[76] Inventor: Adrian H. Krieg, 119 Maplevale Dr., Woodbridge, Conn. 06525

[21] Appl. No.: 177,922

[22] Filed: Apr. 5, 1988

[51] Int. Cl.[4] ..... B65D 81/18; B65D 88/06

[52] U.S. Cl. ..... 206/386; 220/3; 220/408; 280/830

[58] Field of Search ..... 206/0.6, 386; 62/45; 220/3, 5 A, 85 S, 203, 317, 408, 410, 420, 421, 288; 280/5 A–5 E, 5 F–5 H, 5 R, 420, 659

[56] References Cited

U.S. PATENT DOCUMENTS

| | | | |
|---|---|---|---|
| 1,521,148 | 12/1924 | Dennett et al. | 220/421 |
| 2,467,428 | 4/1949 | Hansen et al. | 220/3 |
| 2,907,177 | 10/1959 | Daley et al. | 220/420 |
| 3,078,004 | 2/1963 | Randolph | 280/5 G |
| 3,132,762 | 5/1964 | Gabarro et al. | 220/421 |
| 3,446,388 | 5/1969 | Greenberg | 220/421 |
| 3,461,678 | 8/1969 | Klipping et al. | 220/421 |
| 3,669,301 | 6/1972 | Witkin | 220/288 |
| 4,300,354 | 11/1981 | Buchs et al. | 62/45 |
| 4,481,778 | 11/1984 | Reinker et al. | 62/45 |
| 4,494,666 | 1/1985 | Cooper et al. | 220/3 |
| 4,674,674 | 6/1987 | Patterson et al. | 220/421 |

FOREIGN PATENT DOCUMENTS

| | | | |
|---|---|---|---|
| 0048541 | 2/1911 | Australia | 220/3 |
| 0472059 | 2/1929 | Fed. Rep. of Germany | 220/3 |
| 2578224 | 9/1986 | France | 206/386 |

*Primary Examiner*—Jimmy G. Foster
*Attorney, Agent, or Firm*—John H. Crozier

[57] ABSTRACT

A containment vessel system including a containment vessel into which a leaking fluid-containing cylinder may be quickly placed. The containment vessel is designed to withstand the pressure of the fluid and has closure means that may be quickly secured. Once the leaking cylinder is isolated within the containment vessel, the vessel may be relocated to facilities where the fluid can be properly disposed of. The vessel may be mounted to a carriage which may have wheels, and/or fork lift brackets, and/or lifting lugs to enhance its portability. The containment vessel may be conveniently carried on a cylinder transport truck to permit quick isolation of a leaking cylinder.

10 Claims, 2 Drawing Sheets

CYLINDER CONTAINMENT VESSEL

BACKGROUND OF THE INVENTION

1. Field of the Invention.

The present invention relates to fluid-containing cylinders in general and, more particularly, to a containment vessel into which a leaking fluid-containing cylinder may be placed so as to safely isolate it.

2. Background Art.

Cylinders are widely used, for example, in industry, research, and construction to contain fluids, usually under relatively high pressure. Such fluids are frequently toxic, flammable, or corrosive, sometimes having more than one of these characteristics. The cylinders are, of course, designed for the pressures of the fluids to be contained within them, but corrosion, internal or external, or failure of the outlet valve in the cylinder may cause the fluid to escape. It is, therefore, desirable to be able to minimize the safety hazard posed by a release of the fluid into the surrounding environment.

Heretofore, measures to attempt to provide for the possibility of a leaking cylinder including isolating the cylinder in a building or bunker located distantly from the area of use and piping the fluid to such area of use. When such a cylinder leaks, it may be allowed to simply dissipate its fluid to the atmosphere where dilution renders it harmless. There may be provision for venting the building or bunker to a vent or flare stack and/or it may be removed by personnel wearing safety apparatus. Other measures involve locating the cylinders near the area of use but isolating them in adjacent rooms, sometimes reinforced, or in cabinets. These rooms or cabinets may be under less than atmospheric pressure and may also be connected to vents or flare stacks. In some cases, the cylinders are simply used without any of the above provisions, relying on evacuation of personnel and/or atmospheric dilution for safety.

Another situation where such cylinders present a potential hazard is in their transportation, usually by truck over public roadways. This exposes the public at large to the dangers of leaking cylinders. Heretofore, such situations have generally been handled by the evacuation of people from the area, where the nature of the fluid dictated such action.

In any of the above situations, although measures are taken to safely isolate a leaking cylinder from personnel or personnel from the leaking cylinder, there can be interruptions in production activities or traffic while the fluid in the cylinder is allowed to dissipate. If atmospheric dilution is relied upon, there remains some hazard to life. Even if the immediate danger to life is minimized, there remains the problem of being able to quickly isolate the cylinder to minimize the disruptions noted above. There is the additional problem of being able to easily transport a leaking cylinder to an area or facility where it may be safely dealt with.

Accordingly, it is a principal object of the present invention to provide means to safely isolate a leaking cylinder.

It is another object of the present invention to provide such means to allow the rapid isolation of a leaking fluid-containing cylinder.

It is a further object of the present invention to provide such means that is relatively compact and easily portable.

Other objects of the present invention will, in part, be obvious and will, in part, be apparent from the following description and the accompanying drawing figures.

SUMMARY OF THE INVENTION

The present invention achieves the above objects, among others, by providing, in a preferred embodiment, a containment vessel system including a containment vessel into which a leaking fluid-containing cylinder may be quickly placed. The containment vessel is designed to withstand the pressure of the fluid and has closure means that may be quickly secured. Once the leaking cylinder is isolated within the containment vessel, the vessel may be relocated to facilities where the fluid can be properly disposed of. The vessel may be mounted to a carriage which may have wheels, and/or fork lift brackets, and/or lifting lugs to enhance its portability. The containment vessel may be conveniently carried on a cylinder transport truck to permit quick isolation of a leaking cylinder if necessary during transportation.

DETAILED DESCRIPTION OF THE PREFERRED EMBODIMENT

Figure 1:
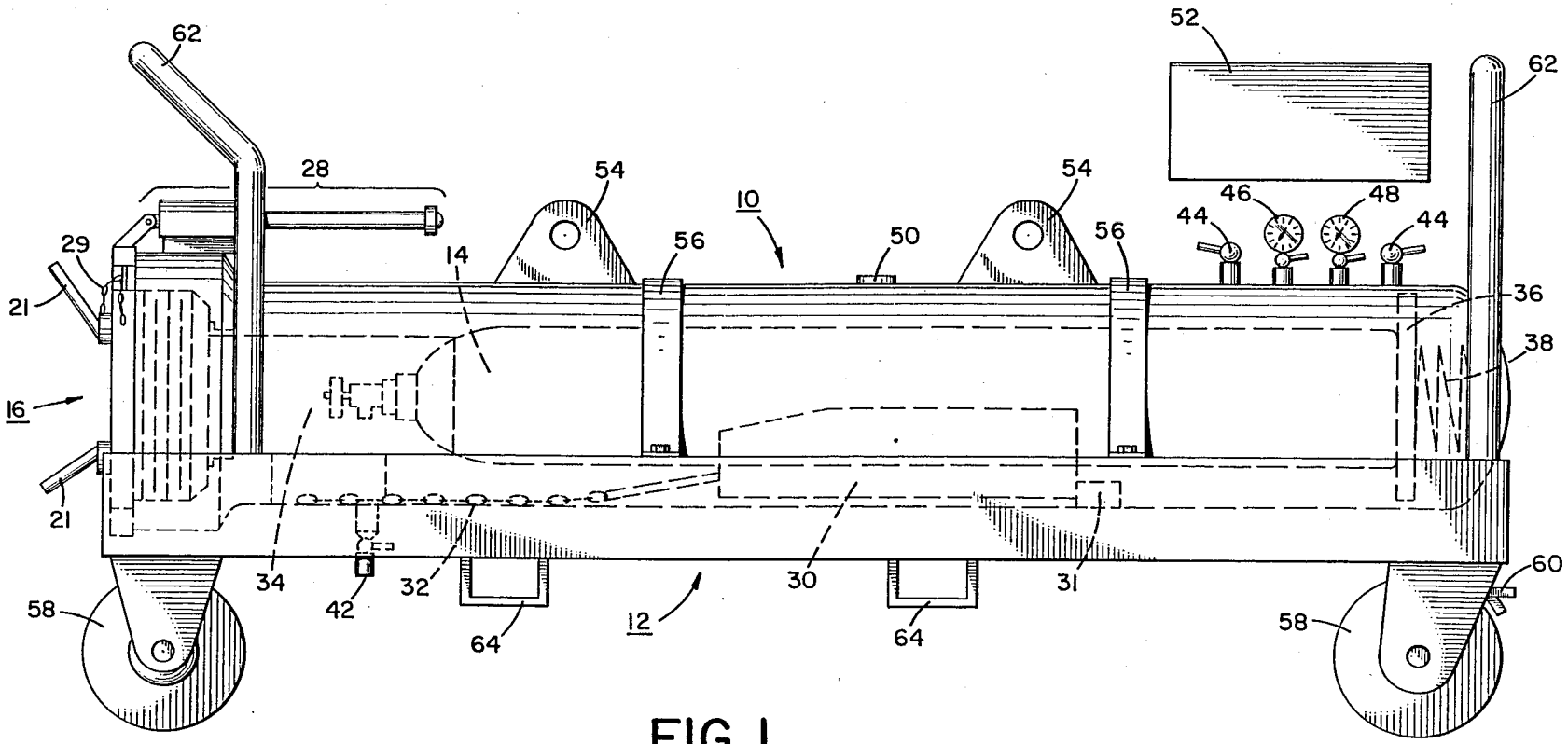
FIG. 1 is a side elevation, partially in crosssection, of a containment vessel according to the present invention mounted on a carriage.
Figure 3:
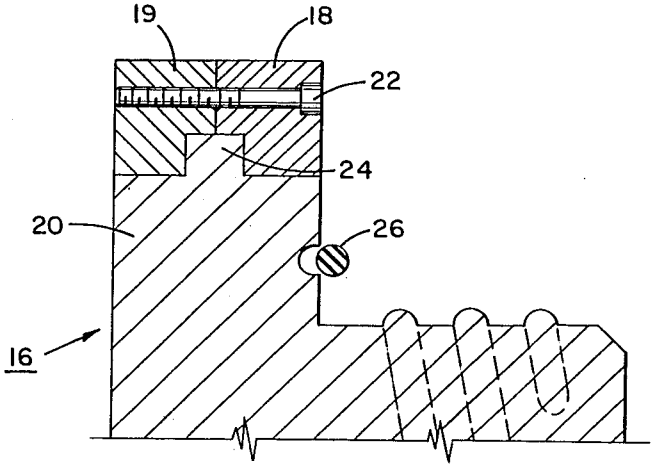
FIG. 3 is a detail showing the construction of the cover assembly of the containment vessel.
Figure 2:
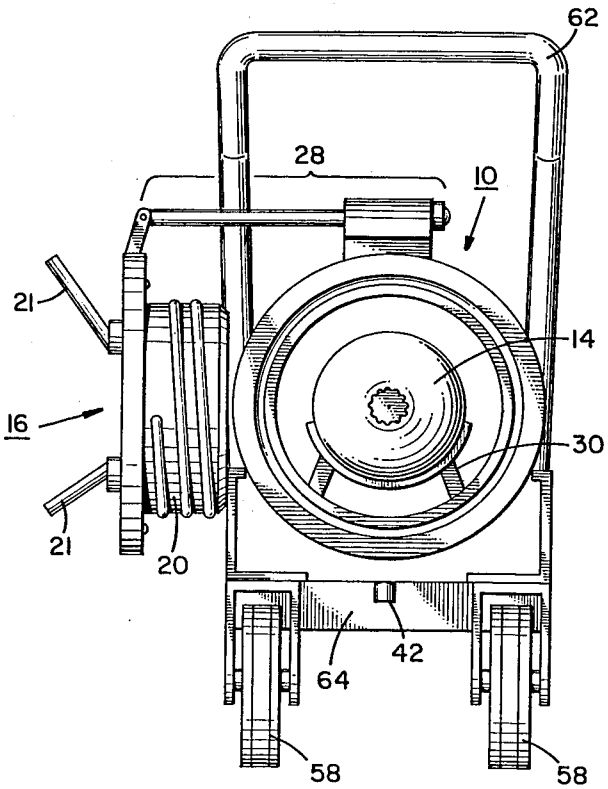
FIG. 2 is an end elevation of the containment vessel and carriage of FIG. 1.

Referring now to the Drawing, FIG. 1 is a side elevation and FIG. 2 is an end elevation of a horizontally disposed, cylindrical containment vessel according to the present invention, generally indicated by the reference numeral 10, which may be mounted on a carriage, generally indicated by the reference numeral 12. Shown within containment vessel 10 is a fluid-containing cylinder 14. Containment vessel 10 is shown on FIG. 1 in its closed position and in FIG. 2 in its open position, closure being effected by means of a cover assembly, generally indicated by the reference numeral 16, which closes the front opening of the containment vessel.

Cover assembly 16 includes inner and outer flange rings 18 and 19, respectively, and a threaded plug 20 having handles 21 fixed thereto for manual rotation thereof. Inner and outer rings are joined by threaded fasteners, as at 22, and when so joined, define therebetween an annular channel in which a flange 24 on the outer periphery of threaded plug 20 is rotatably disposed, so that rotation of the plug will advance it into engagement with corresponding threads in the opening of containment vessel 10 to effect closure thereof. Cover assembly 16 includes an O-ring 26 on the inner vertical surface of threaded plug 20 to form a seal between that surface and the front end of containment vessel 10 when the containment vessel is in its closed position.

Cover assembly 16 is rotatably supported by hinge mechanism 28 which permits the cover assembly to be moved entirely away from the bore of containment vessel 10 to facilitate the loading and unloading of cylinder 14 into and from the containment vessel. When containment vessel 10 is in its closed position, it may be locked in that position by means of a chain 29 (not shown on FIG. 2) attached to cover assembly 16, looped around hinge mechanism 28, and padlocked (not shown); or other locking means known in the art may be employed. While cover assembly is shown as effecting a threaded closure, it will be understood that any closure means known in the art such as, for example, a breech mechanism or a bolted flange are within the scope of the present invention. It is also within the intent of the present invention to provide mechanically or electromechanically actuated closure means known in the art.

Cylinder 14 may be radially supported within containment vessel 10 by means of a saddle 30 which prevents radial movement of cylinder 14 with respect to the containment vessel and which is preferably a sliding saddle adapted for back-and-forth motion along the bottom of the inner periphery of the containment vessel. A chain 32 (not shown on FIG. 2) is attached to sliding saddle 30. The extent of travel of sliding saddle 30 toward the rear of containment vessel 10 is limited by stop plate 31. Cylinder 14 may be held against axial motion relative to containment vessel 10 by means of: (1) rigid tube 34 (not shown on FIG. 2) which is supported by the bottom of the inner periphery of the containment vessel and one end of which tube bears against the upper end of the cylinder and the other end of which tube bears against the inner surface of cover assembly 16, and (2) plate 36 against which the bottom of the cylinder bears and which plate is biased toward the bottom of the cylinder by means of spring 38. Tube 34 and plate 36 are preferably perforate (perforations not shown).

Containment vessel 10 may be fitted, as shown, with a liquid drain valve 42, gas vent valves 44, a pressure gage 46, a vacuum gage 48, and a pressure relief plug 50. Gages 46 and 48 may also comprise a single compound gage. A cover 52 may be provided to protect the gages and valves mounted on the top of containment vessel 10 from damage and dirt. Containment vessel 10 may also have lifting eyes 54 attached thereto for convenient lifting thereof by a crane or the like.

Containment vessel 10 is shown removably fixed to carriage 12 by means of straps 56. Carriage 12 preferably comprises a metal frame and may include wheels 58 to allow movement of the carriage along a surface (not shown) and a wheel brake 60 to prevent such movement when desired. Carriage 12 may also include handles 62 to facilitate manual maneuvering of the wheeled carriage and fork lift brackets 64 to facilitate positioning of the carriage with a fork lift truck or the like.

Containment vessel 10 may be constructed of any suitable material, such as steel or stainless steel, and is preferably designed to ASTM pressure vessel standards. If containment vessel is provided with about a 13-inch internal diameter and about a 84-inch length, it will accommodate most standard cylinders; although, any dimensions suitable for the cylinders to be accommodated are within the intent of the present invention. Containment vessel 10 may also be adapted to be disposed in a vertical position (not shown), in which case, means would be provided to prevent radial motion of cylinder 14 in any direction with respect to the containment vessel.

In use, containment vessel 10 which is preferably left open and located in or near the area of cylinder use so that it may be rapidly moved to a leaking cylinder. Sliding saddle 30 is pulled by means of a chain 32 to the front of containment vessel 10 and the cylinder is lifted, manually or with mechanical assistance, and the bottom end thereof inserted into the containment vessel until the cylinder is approximately centered on the sliding saddle. Then, sliding saddle 30 is released and allowed to slide along the bottom of the bore of containment vessel 10 as the cylinder is advanced further into the containment vessel. When the bottom of cylinder 14 has engaged plate 36, tube 34 is placed in position, as shown in FIG. 1, cover assembly 16 is moved into position, threaded plug 20 is rotatingly advanced into a threaded portion of the bore of containment vessel 10 until O-ring 26 has formed a tight seal between the plug and the front surface of the containment vessel, during which closure operation the cylinder is being secured against axial motion relative to the containment vessel by means of the compression of spring 38.

It can be seen that the entire operation of placing a cylinder in containment vessel 10 and securing the same therein can be accomplished quickly with minimum exposure of personnel to the leaking contents of the cylinder. Of course, it is expected that personnel effecting the containment would be equipped with whatever safety equipment is required for exposure to the contents. Once containment is complete, normal operations or transportation may be resumed, any emergency status created by the leak may be terminated, and containment vessel 10 may, if necessary, be relocated to an appropriate location for purging of the leaking fluid.

Containment vessel 10 includes several means to aid in purging the fluid from the vessel: for example, liuqid in the containment vessel may be purged through a hose or piping connected to liquid drain 42; gas may be purged through a hose or piping connected to gas vent valves 44; a purging gas may enter through the liquid drain valve and exit a gas vent valve; a purging liquid may enter a gas vent valve and exit the liquid drain valve; and/or a source of vacuum may be connected to a gas vent valve. The internal condition of containment vessel 10 may be determined by readings on gages 46 and/or 48 and/or by chemical or other analysis of the streams exiting the containment vessel. The perforations in tube 34 and plate 36 help assure that purging will be complete. It is assumed that material purged from containment vessel 10 will be handled and/or disposed of in accordance with normal safety practices for such material.

It will thus be understood that the objects set forth above, among those made apparent from the foregoing description, are efficiently attained and, since certain changes may be made in the above construction without departing from the scope thereof, it is intended that all matter contained in the above description or shown on the accompanying drawing figures shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A containment vessel system for a fluidcontaining cylinder, comprising:

(a) a horizontally disposed cylindrical tank having a bore sized to accommodate therein said cylinder;

(b) closure means at one end of said containment vessel, which closure means can be opened to insert said cylinder in said containment vessel and which can be closed to seal said containment vessel to prevent the escape therefrom of fluid which may leak from said cylinder; and (c) means upon which said cylinder is axially adjustably disposed to prevent said cylinder from moving radially with respect to said containment vessel.

2. A containment vessel system, as defined in claim 1, further comprising:

(f) means to drain liquid from said containment vessel.

3. A containment vessel system, as defined in claim 1, further comprising:

(g) means to vent gas from said containment vessel.

4. A containment vessel system, as defined in claim 1, further comprising:

(h) means to indicate the pressure in said containment vessel.

5. A containment vessel system, as defined in claim 1, wherein said containment vessel is fixedly mounted to a carriage.

6. A containment vessel system, as defined in claim 5, wherein said carriage is wheeled.

7. A containment vessel system, as defined in claim 5, wherein said carriage includes thereon fork lift brackets.

8. A containment vessel system, as defined in claim 6, wherein said carriage has at least one handle to facilitate manual positioning of said carriage.

9. A containment vessel system, as defined in claim 1, wherein said means upon which said cylinder is disposed is adapted for back-and-forth movement along the bottom of said bore of said containment vessel.

10. A containment vessel system, as defined in claim 1, further comprising:

(d) rigid means having first and second ends, said first end engaging the top of said cylinder and said second end engaging said closure means when said closure means is in its closed position; and (e) biasing means urging said cylinder toward said closure means;

whereby said cylinder is prevented from moving axially with respect to said containment vessel.

* * * * *